United States Patent [19]

Reindel

[11] 3,993,966

[45] Nov. 23, 1976

[54] IN-LINE WAVEGUIDE TO COAX TRANSITION

[75] Inventor: John Reindel, San Diego, Calif.

[73] Assignee: The United States of America as represented by the Secretary of the Navy, Washington, D.C.

[22] Filed: June 16, 1975

[21] Appl. No.: 587,445

[52] U.S. Cl. ..... 333/21 R; 333/34; 333/35

[51] Int. Cl.[2] ..... H01P 1/16; H01P 5/10

[58] Field of Search ..... 333/21 R, 26, 33, 34, 333/35

[56] References Cited

UNITED STATES PATENTS

| | | | |
|---|---|---|---|
| 2,943,275 | 6/1960 | Bittner et al. | 333/34 X |
| 3,188,583 | 6/1965 | Boyd | 333/35 X |
| 3,478,282 | 11/1969 | Smith | 333/34 X |

*Primary Examiner*—Paul L. Gensler
*Attorney, Agent, or Firm*—R. S. Sciascia; G. J. Rubens; H. Fendelman

[57] ABSTRACT

A transition apparatus for changing from a waveguide to a coaxial connector. A tapered or stepped ridge waveguide section is electrically connected to a section of microstrip which is electrically connected to a coaxial connector, the coaxial connector being in line with the waveguide.

9 Claims, 5 Drawing Figures

IN-LINE WAVEGUIDE TO COAX TRANSITION

BACKGROUND OF THE INVENTION

Many different waveguide to coaxial transition devices have been built in the past. The prior art broadband transitions typically used double, tapered ridged transitions to coaxial connectors fastened to one of the broad walls of the waveguide. For many assemblies it is a disadvantage to have the coaxial connector at a 90° angle to the waveguide. Another disadvantage of these assemblies is the difficult mechanical construction and the cost of the device.

SUMMARY OF THE INVENTION

The present invention provides an in-line transition with low loss and VSWR over a broad frequency band. This in-line design is mechanically stronger and significantly easier to manufacture than the prior art devices having a 90° bend. Due to the symmetry of the device, it can be manufactured by machining two identical halves of the assembly. The present device, therefore, thus solves the need for smaller and more broadband coaxial connections for existing microwave components requiring low loss and VSWR.

STATEMENT OF THE OBJECTS OF THE INVENTION

It is the primary object of the present invention to disclose a novel waveguide to coaxial line transition.

It is another object of the present invention to disclose an in-line waveguide to coax transition.

Other objects, advantages and novel features of the invention will become apparent from the following detailed description of the invention when considered in conjunction with the accompanying drawings.

DESCRIPTION OF THE PREFERRED EMBODIMENT

Figure 1:
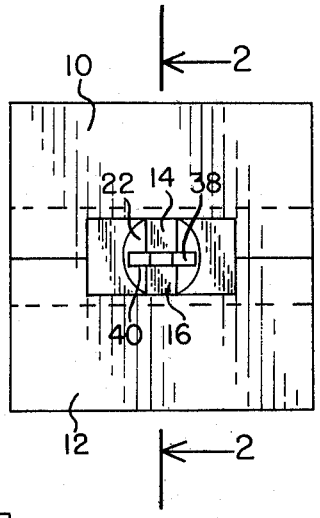
FIG. 1 is an end view of the transition apparatus of the present invention.
Figure 4:
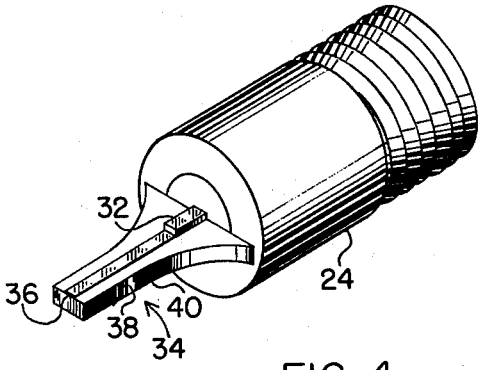
FIG. 4 is a perspective view of the microstrip, coaxial connector portion of the present invention.
Figure 2:
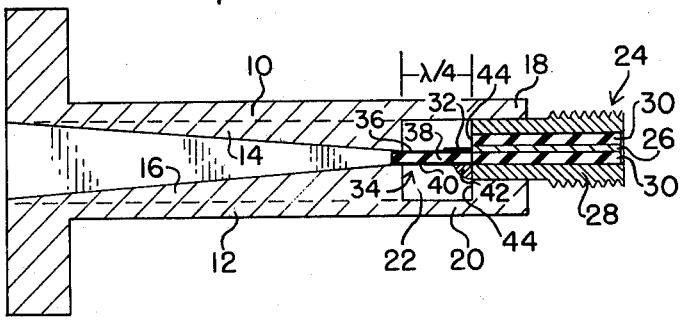
FIG. 2 is a transverse section through section 2—2 of FIG. 1.
Figure 3:
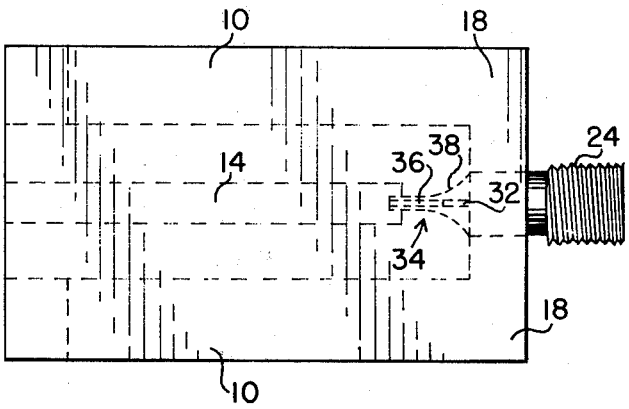
FIG. 3 is a top view of the present invention.

Referring now to FIGS. 1 through 4, the invention is seen to comprise two assembly halves 10 and 12 of a suitable conductive waveguide material. The assemblies are provided with tapered ridges 14 and 16 to form a double-tapered ridge waveguide section. The upper and lower assemblies 10 and 12 are provided with end portions 18 and 20 which are constructed so as to provide a cavity 22 therebetween and an aperture through which a coaxial connector 24 may be placed. Coaxial connector 24 is a conventional device comprised of inner conductor 26 separated from outer conductor 28 by a suitable dielectric 30 such as Teflon. Connector tab 32 is electrically and mechanically connected to the inner conductor 26 and extends outwardly from the coaxial connector for external connection as is illustrated in the drawings. Interconnecting the coaxial connector 24 and the waveguide ridges 14 and 16 is a section of microstrip medium 34 comprised of a line conductor 36, a dielectric 38, and a ground plane conductor 40. As is seen more clearly in FIG. 4 the dielectric 38 and ground plane 40 of the microstrip medium 34 are flared outwardly from the points of contact with ridges 14 and 16 to the points of contact with coaxial connector 24. The ground plane conductor 40 may be electrically connected to the coaxial connector outer conductor 28 by means of a solder joint 42 and line conductor 36 may also be soldered to tab connector 32 to provide electrical connection.

The ridged transition comprised of ridges 14 and 16 converts the waveguide field from the standard $TE_{10}$ mode to that of a ridged waveguide in which most of the E-fields are concentrated between a narrow gap between the ridges. The fields of the microstrip circuit medium 34 are very similar except for the fringing fields of the ridged waveguide. Most of the energy is therefore transmitted from the ridged waveguide to the microstrip circuit medium 34 without reflections. The fringing fields propagate from the transition to the wall 44 and are reflected back towards the discontinuity. By adjusting the length of the cavity 22 to be the equivalent of ¼ wavelength at the midband of the operating frequency, a cancellation of fields takes place and the input match is improved. Since the field distribution in the coaxial connector 24 is radial between the inner and outer conductors 26 and 28, respectively, the microstrip circuit medium 34 is flared, as illustrated to increase the field distribution and to provide a smooth transition from the field supported by the microstrip circuit medium 34 to the field supported by the coaxial connector 24.

Figure 5:
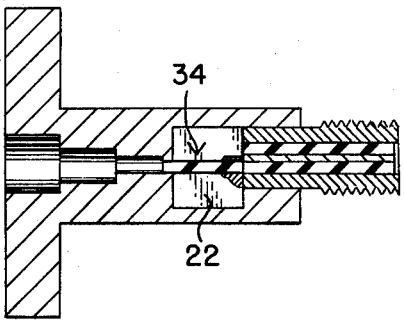
FIG. 5 is a sectional view of the present invention utilizing a stepped, dual-ridge waveguide transformer.

It is noted that the present invention is not restricted to the double tapered ridged transition illustrated in FIGS. 1 through 4 but may also be employed with other types of waveguide transformer sections such as the stepped dual-ridged type illustrated in FIG. 5, the well-known cosine tapered transition, or any other suitable form of waveguide transformer transition. Obviously, various other modifications, changes and adaptations may be made without departing from the spirit of the present invention and the scope of the appendant claims.

What is claimed is:

1. A waveguide to coaxial cable transition apparatus comprising:

a section of waveguide having top and bottom portions, said section of waveguide having first and second tapered ridges on the inner walls of said top and bottom portions, respectively;

a section of microstrip medium having a ground plane, a line conductor and a dielectric therebetween, said line conductor being in contact with said waveguide top portion and said ground plane being in contact with said waveguide bottom portion;

a coaxial connector having a connecting tab extending from an inner conductor and also having an outer conductor;

said line conductor being in contact with said connecting tab and said ground plane being in contact with said outer conductor;

the longitudinal axis of said coaxial connector being parallel with the longitudinal axis of said section of waveguide.

2. A waveguide to coaxial cable transition apparatus comprising:

a section of waveguide having top and bottom portions, said section of waveguide having first and second stepped ridges on the inner walls of said top and bottom portions, respectively;

a section of microstrip medium having a ground plane, a line conductor and a dielectric therebetween, said line conductor being in contact with said waveguide top portion and said ground plane being in contact with said waveguide bottom portion;

a coaxial connector having a connecting tab extending from an inner conductor and also having an outer conductor;

said line conductor being in contact with said connecting tab and said ground plane being in contact with said outer conductor;

the longitudinal axis of said coaxial connector being parallel with the longitudinal axis of said section of waveguide.

3. A waveguide to coaxial cable transition apparatus comprising:

a section of waveguide having top and bottom portions;

a section of microstrip medium having a ground plane, a line conductor and a dielectric therebetween, said line conductor being in contact with said waveguide top portion and said ground plane being in contact with said waveguide bottom portion, said ground plane and dielectric of said section of microstrip medium increasing in width from the points of contact with said waveguide top and bottom portions to the points of contact with said coaxial connector inner and outer conductors;

a coaxial connector having a connecting tab extending from an inner conductor and also having an outer conductor;

said line conductor being in contact with said connecting tab and said ground plane being in contact with said outer conductor;

the longitudinal axis of said coaxial connector being parallel with the longitudinal axis of said section of waveguide.

4. The apparatus of claim 3 wherein said waveguide top and bottom portions include first and second conductive extensions forming a cavity therebetween;

said cavity encompassing said microstrip medium.

5. The apparatus of claim 4 wherein the length of said cavity is approximately $\lambda/4$ where $\lambda$ is the device mid-band operating wavelength.

6. A waveguide to coaxial cable transition apparatus comprising:

a waveguide section having a top portion with an inner wall surface and a bottom portion with an inner wall surface opposing said top portion inner wall surface, said top portion inner wall surface and said bottom portion inner wall surface being separated by a first distance at a first end of said waveguide section and by a second distance less than said first distance at a second end of said waveguide section;

first and second conductive extensions extending at said second end of said waveguide section from said waveguide top and bottom portions, respectively, and forming a cavity therebetween;

a microstrip medium positioned substantially within said cavity having a line conductor with a first end in electrical contact with said waveguide top portion and a ground conductor with a first end in electrical contact with said waveguide bottom portion;

a coaxial connector disposed between the ends of said first and second extensions having an inner conductor and an outer conductor, said inner conductor being in electrical contact with a second end of said line conductor and said outer conductor being in electrical contact with a second end of said ground conductor.

7. The apparatus of claim 6 wherein said microstrip medium includes a dielectric between said line conductor and said ground conductor, said dielectric and said ground plane increasing in width between said first and second ends of said line and ground conductors.

8. The apparatus of claim 6 wherein the longitudinal axis of said coaxial connector is parallel with the longitudinal axis of said waveguide section.

9. The apparatus of claim 6 wherein the length of said cavity is approximately $\lambda/4$ where $\lambda$ is the device mid-band operating wavelength.

* * * * *